United States Patent [19]

Kimura et al.

[11] 4,189,391

[45] Feb. 19, 1980

[54] ELECTRICAL INSULATING OIL COMPOSITIONS

[75] Inventors: Shoji Kimura, Chigasaki; Noboru Ishida, Sagamihara; Midori Masunaga, Tokyo; Yoshiki Kohno, Kawasaki, all of Japan

[73] Assignee: Nippon Oil Co., Ltd., Tokyo, Japan

[21] Appl. No.: 904,098

[22] Filed: May 8, 1978

Related U.S. Application Data

[63] Continuation-in-part of Ser. No. 791,280, Apr. 27, 1977, abandoned.

[30] Foreign Application Priority Data

May 1, 1976 [JP] Japan ..... 51-49405

[51] Int. Cl.[2] ..... H01B 3/22

[52] U.S. Cl. ..... 252/63; 208/14

[58] Field of Search ..... 208/14; 252/59, 63, 252/66, 71

[56] References Cited

U.S. PATENT DOCUMENTS

| | | | |
|---|---|---|---|
| 3,095,366 | 6/1963 | Schieman | 252/63 |
| 3,617,473 | 11/1971 | Lipscomb | 208/14 |
| 3,668,128 | 6/1972 | Anderson | 252/63 |
| 4,033,854 | 7/1977 | Ohmori et al. | 208/14 |
| 4,069,165 | 1/1978 | Masunaga et al. | 208/14 |

*Primary Examiner*—Herbert Levine

*Attorney, Agent, or Firm*—Frank J. Jordan

[57] ABSTRACT

An electrical insulating oil composition consisting essentially of (I) 50–95 parts by weight of a mineral oil-derived electrical insulating oil, (II) 5–50 parts by weight of at least one oil selected from diarylalkanes, polybutene, an oil having a specified refractive index and a hydrocarbon oil-derived hydrofined oil, and (III) 0.001–1.0% by weight of a hydrocarbon-derived pour point depressant, based on the total weight of the oils (I) and (II).

10 Claims, No Drawings

ELECTRICAL INSULATING OIL COMPOSITIONS

This is a continuation-in-part application of Ser. No. 791,280 filed Apr. 27, 1977 now abandoned.

This invention relates to a mineral oil-derived electrical insulating oil having improved pour point.

Electrical insulating oils of mineral oil origin have heretofore generally been produced from a naphthenic base crude oil as the starting oil. It has recently been expected to produce from a mixed or paraffinic base crude oil which is available at a relatively low cost in large quantities. However, electrical insulating oils of mixed or paraffinic crude oil origin are disadvantageous in that they have a high pour point.

This invention is applicable to the improvement of all mineral oil-derived electrical insulating oils in pour point and is particularly valuable in improving in pour point electrical insulating oils produced from the mixed or paraffinic base crude oil as the starting oil.

The electrical insulating oil composition of this invention consists essentially of (I) 50–95 parts by weight of a mineral oil-derived electrical insulating oil, (II) 5–50 parts by weight of a member selected from the group consisting of (1) at least one diarylalkane, (2) polybutene, (3) a highly aromatic oil having a refractive index of ($n_d^{20}$) 1.56–1.60 obtained by hydrofining a distillate contained in a fraction having a boiling range of about 250°—about 400° C. at atmospheric pressure obtained by the pyrolysis of petroleum at a temperature of about 600°—about 900° C. and (4) an oil obtained by hydrofining a distillate contained in a fraction having a boiling range of about 230°-about 450° C. at atmospheric pressure produced as a by-product by reforming a hydrocarbon oil in the presence of a noble metal catalyst and (III) 0.001–1.0% by weight of a hydrocarbon-derived pour point depressant, based on the total weight of the oils (I) and (II). Thus, this invention is based on the finding or discovery that the addition of both the oil (II) and oil (III) to the oil (I) exhibits such an unexpectedly great pour point-depressing action on the oil (I) as may not be expected from the addition of the oil (II) alone or the oil (III) alone to the oil (I).

This invention will be detailed hereinbelow.

The mineral oil-derived electrical insulating oil (I) may be one which is produced from any of naphthenic, mixed and paraffinic base crude oils, or may be blends of the oils so produced.

The naphthenic base crude oils used herein is one containing naphthenic hydrocarbons in large proportions and more particularly the crude oil is such that its first key fraction (kerosene fraction) has an API gravity of not greater than 33° and its second key fraction (lubricating oil fraction boiling at 275°–300° C. at a reduced pressure of 40 mm of mercury) has an API gravity of not greater than 20°. As is described in "Sekiyu Binran (Handbook on Petroleum)" on page 19, 1972 edition published by Sekiyu Shunju Co., Ltd., Japan; typical of the naphthenic base crude oils are a California crude oil, a Texas crude oil, a Mexico crude oil, a Venezuela crude oil and a Duri crude oil.

The paraffinic crude oil used herein is one containing paraffinic hydrocarbons in large proportions and more particularly the crude oil is such that its first key fraction has an API gravity of not less than 40° and its second key fraction has an API gravity of not less than 30° as is described in said Handbook on Petroleum; typical of the paraffinic base crude oils are a Pennsylvania crude oil, a Minas crude oil and the like.

The mixed base crude oil used herein is one which is qualitatively intermediate between the paraffinic and naphthenic base crude oils and more particularly the mixed base crude oil is such that its first key fraction has an API gravity of 33°–40° and its second key fraction an API gravity of 20°–30°; typical of the mixed base crude oils are a Midcontinent crude oil, an Arabia crude oil, a Khafji crude oil and the like.

This invention is applicable to an electrical insulating oil, as a base oil, of naphthenic, mixed or paraffinic origin, as previously mentioned.

There have heretofore known many processes for the preparation of electrical insulating oils from naphthenic base crude oils, the processes including a process comprising hydrofining a mineral oil to effect a 65–96% desulfurization and then treating the thus-desulfurized mineral oil with a solid adsorbent (Japanese Pat. Gazette No. 18584/61) and a process comprising blending a mineral oil raffinate in hydrogenated form having an aromatic content of not higher than 23% by weight with not more than 15% by weight of a lubricating oil having a higher aromatic content than the hydrogenated raffinate (Japanese Pat. Gazette No. 3589/66).

Processes for the preparation of electrical insulating oils from paraffinic base crude oils include, for example, a process comprising distilling a distillate obtained by dewaxing a vacuum distilled gas oil fraction 5–95% of which boils at 288°–399° C. (550°–750° F.) and recovering a heart cut thereby obtaining an electrical insulating oil (Japanese Pat. Gazette No. 46123/74).

The present inventors have already filed a patent application for a process for the preparation of an electrical insulating oil which comprises refining with furfural or other suitable solvents at 50°–100° C. a distillate having a boiling range of 250°–400° C. at atmospheric pressure obtained by the distillation of a paraffinic or mixed base crude oil at atmospheric pressure or by the distillation at a reduced pressure of a bottom oil obtained by the distillation of the crude oil at atmospheric pressure, to effect a 30–75 wt.% desulfurization thereby obtaining a raffinate, hydrofining the thus obtained oil to remove therefrom 40–90 wt.% of the sulfur contained therein, solvent dewaxing the desulfurized oil and, if desired, successively treating the dewaxed desulfurized oil with clay thereby to obtain the electrical insulating oil having a sulfur content of 0.1–0.35 wt.%, satisfactory oxidation stability, electrical properties and resistance to copper corrosion (Japanese Patent Appln. No. 12152/74 and U.S. Pat. No. 4,008,148), and they have also already filed a patent application for a process for the preparation of an electrical insulating oil having a total sulfur content of not more than 0.35 wt.%, excellent oxidation stability, thermal stability, corona resistance and corrosion resistance which consists essentially of (I) 80–99 parts by weight of a refined oil obtained by solvent refining a distillate contained in a fraction having a boiling range of 230°–430° C. at atmospheric pressure, the fraction being obtained by the distillation of a paraffinic or mixed base crude oil at atmospheric pressure or by the distillation at a reduced pressure of a bottom oil obtained by the distillation of the crude oil at atmospheric pressure, to produce a raffinate, hydrofining the raffinate so produced, solvent dewaxing the thus-hydrofined oil and, if desired, treating the dewaxed hydrofined oil with a solid adsorbent thereby to obtain the refined oil having a sulfur content of no higher than 0.25 wt.% and an aromatic content of from more than 25 wt.% to 35 wt.% and (II) 1–20 parts by weight of a refined oil obtained by treating the lubricating fraction of a mineral oil with a solid adsorbent (Japanese Patent Appln. No. 17480/75 and U.S. Pat. Appln. Ser. No. 656906 filed Feb. 2, 1976 now U.S. Pat. No. 4,072,620).

There have been known various processes for the preparation of electrical insulating oils from any one of crude oils. Typical of them is a process for preparing an electrical insulating oil by either providing a lubricating oil fraction obtained by distilling at a reduced pressure a bottom oil obtained by the distillation of the crude oil at atmospheric pressure or providing a fraction having a boiling range of about 260°–400° C. at atmospheric pressure obtained by deasphalting the bottom oil to obtain a heavy oil, subjecting the thus-obtained heavy oil to hydrogenolysis at a temperature of not lower than 350° C. and a high hydrogen pressure of not lower than 150 kg/cm$^2$G and distilling the thus-hydrogenolyzed oil to obtain a fraction having a boiling range within the range of about 260°–400° C. at atmospheric pressure, and, if necessary, successively dewaxing the fraction with a suitable solvent thereby to prepare the electrical insulating oil.

This invention may of course by applicable not only to electrical insulating oils obtained by the said typical process but also those of mineral oil origin obtained by any other process, irrespective of the manner of the processes.

The second component oil (II) of the electrical insulating oil composition is at least one member selected from the group consisting of (1) at least one diarylalkane, (2) polybutene, (3) a highly aromatic oil having a refractive index of ($n_d^{20}$) 1.56–1.60 obtained by thermocracking petroleum at about 600°–900° C. to obtain a fraction having a boiling range within the range of about 250°–400° C. at atmosheric pressure and hydrofining the fraction so obtained and (4) an oil obtained by hydrofining a fraction having a boiling range within the range of about 230°–450° C. at atmospheric pressure, the fraction being obtained at the time of reforming a hydrocarbon oil in the presence of a noble metal catalyst.

The diarylalkane (1) according to this invention is a compound represented by the following general formula

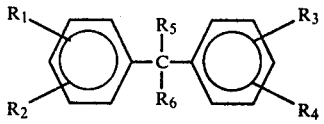

wherein $R_1$, $R_2$, $R_3$ and $R_4$ are each hydrogen or an alkyl group having 1–15 carbon atoms with the proviso that the total of the carbon atoms of $R_1$–$R_4$ is at least 2, and $R_5$ and $R_6$ are hydrogen or a methyl group. The diarylalkanes may be produced easily at a low cost from aromatic compounds obtainable in the petrochemical industry, by the use of any one of various known processes. These known processes include a process comprising reacting styrene, α-methylstyrene or their alkyl derivative with benzene or an alkylbenzene in the presence of an acid catalyst such as sulfuric acid or a cationic ion exchange resin and a process comprising dehydrochlorination condensing an aryl chloride with benzene or an alkylbenzene in the presence of a Friedel-Crafts type catalyst. Diarylalkanes produced by the use of other known processes may also be used in the practice of this invention. In addition, there may further be used diarylalkanes containing not more than 10% of a by-product produced at the time of reaction for producing the diarylalkanes. Typical of the diarylalkanes are α-methylbenzyltoluene, α,α'-dimethylbenzyltoluene, α-methylbenzylxylene, α,α'-dimethylbenzylxylene and mixtures thereof.

The polybutene (2) used herein is a liquid polymer consisting mainly of isobutylene and is obtained by polymerizing a butane-butene fraction, obtained as a by-product when naphtha, for example, is thermocracked in attempts to produce ethylene, propylene or the like, at a temperature of about −30° to 30° C. in the presence of a Friedel-Crafts type catalyst such as aluminum chloride. The polybutene used herein should have an average molecular weight of about 200–400, preferably about 250–300.

The highly aromatic oil (3) having a refractive index of ($n_d^{20}$) 1.56–1.60 according to this invention is obtained by hydrofining a distillate contained in a fraction having a boiling range of about 250°–400° C. at atmospheric pressure obtained by cracking petroleum at a temperature of about 600°–900° C. The highly aromatic oil will be further detailed hereinbelow.

Hydrocarbons having at least 5 carbon atoms are obtained as a by-product when naphtha, kerosene, gas oil or other petroleum is subjected to steam cracking, thermocracking, catalytic cracking or the like at approximately 600°–900° C. to produce therefrom ethylene, propylene and other lower olefins. Among these olefins, the olefins having 5 and 9 carbon atoms are partly used as a starting material for petroleum resins, those having 6–8 carbon atoms are used as a starting material for producing benzene, toluene and xylene and those having at least 9 carbon atoms except for those having 9 carbon atoms for the petroleum resins are used in the practice of this invention. The residual cracked oil obtained by the aforesaid naphtha cracking is very highly aromatic substantially without paraffinic and naphthenic oils being contained. The residual cracked oil is distilled at a reduced pressure to separate therefrom a fraction having a boiling range within the range of about 250°–400° C. Or the cracked oil is distilled at a reduced pressure to separate it into a liquid material boiling at not higher than about 400° C. and a heavy material boiling at not lower than this temperature. Then, said liquid material is heat treated at not higher than about 200° C. at atmospheric or superatmospheric pressure for longer than about one hour or else it is catalytically heat treated in the presence of a Friedel-Crafts type catalyst to polymerize alkylindenes and other unsaturated compounds contained therein thereby converting it to a heavy material which is then distilled to remove therefrom a polymerized material having a boiling range of higher than 400° C. while recovering a distillate having a boiling range within the range of about 250°–400° C. The boiling range of the distillate used herein may include preferably at least about 80%, more preferably at least 90% of said range of about 250°–400° C. The distillate so recovered is then hydrofined to obtain a desired highly aromatic hydrocarbon having a refractive index of ($n_d^{20}$) 1.56–1.60 and a specific dispersion of not lower than 200, preferably 225–300. The catalysts used for said hydrofining may be conventional known ones such as, preferably, nickel, molybdenum and cobalt oxides and sulfides supported on an alumina-containing carrier; the most preferable catalyst is preliminarily sulfurized nickel oxide-molybdenum oxide supported on an alumina carrier. In the hydrofining, the pressure used is usually in the range of 20–100 kg/cm$^2$G, preferably 25–60 kg/cm$^2$G; the reaction temperature used is in the range of 230°–400° C., preferably 260°–340° C.; and the amount of hydrogen fed is in the range of 100–10,000 Nm$^3$, preferably 200–1,000 Nm$^3$.

The hydrofined oil (4) according to this invention obtained by hydrofining a distillate contained in a fraction having a boiling range of about 230°–450° C. at atmospheric pressure produced as a by-product at the time of reforming a hydrocarbon oil in the presence of a noble metal catalyst, will be detailed hereunder. A hydrocarbon oil, such as straight-run naphtha or cracked gasoline, having a boiling range of about 40°–200° C., preferably about 60°–180° C., is reformed in the presence of a noble metal catalyst to produce a high octane number gasoline, benzene, toluene, xylene and other aromatic hydrocarbons simultaneously with the production, as a by-product, of a fraction having a boiling range of about 230°–450° C. at atmospheric pressure in which is contained a heavy oil distillate usable as material for the hydrofined oil (4) in the practice of this invention. The boiling range of the hydrofined oil (4) may include preferably at least 80%, more preferably at least 90%, of that of the said fraction boiling at about 230°–450° C. The heavy oil distillate is usable as the hydrofined oil (4) without need of distillation thereof if it meets the requirements for the oil (4); however, it may be preferable to obtain such a usable distillate meeting the said requirements by distillation of the original heavy oil distillate. Almost all of the usable heavy oil distillate consists of polycyclic aromatic hydrocarbons having at least 10 carbon atoms. The noble metal catalysts used herein may be those which are known to be usable for such a reaction as above. Particularly preferable catalysts include metals of the Platinum Group of the Periodic Table and mixtures thereof, each supported on a solid carrier. There may also preferably be used catalysts comprising the Platinum Group metal and mixtures thereof in combination with at least one member selected from Ge, Sn, Re, Fe, Pb and halogens, the catalysts being supported on a solid carrier. The solid carriers which may preferably be used include alumina, silica, zeolite and silica-alumina. The reforming reaction according to this invention may be carried out at a reaction pressure of 1–50 kg/cm$^2$G, preferably 5–40 kg/cm$^2$G and a reaction temperature of 400°–600° C., preferably 470°–530° C., at a hydrogen feed rate of 100–1,500 Nm$^3$, preferably 300–1,000 Nm$^3$, per Kl of oil and at a liquid hourly space velocity (LHSV) of 0.5–5 hr$^{-1}$, preferably 1–3 hr$^{-1}$. The aforesaid heavy oil distillate is usually subjected to hydrofining treatment thereby obtaining a desired hydrofined oil (5). The hydrofining catalysts used herein include the oxides, sulfides and mixtures thereof of metals of the Groups IB, IV and VIII of the Periodic Table, the catalysts being supported on an inorganic carrier such as bauxite, activated carbon, diatomaceous earth, zeolite, silica, alumina or silica-alumina. The preferable metals of the Groups IB, IV and VIII include cobalt, nickel, molybdenum and tungsten. Particularly preferable catalysts are those comprising a mixture of at least two of molybdenum oxide, tungsten oxide and cobalt oxide, the mixture being supported on an alumina carrier. In the hydrofining treatment, the reaction temperature used is 230°–400° C., preferably 260°–360° C.; the reaction pressure used is usually 20–150 kg/cm$^2$G, preferably 25–80 kg/cm$^2$G; the hydrogen feed rate used is 100–10,000 Nm$^3$, preferably 200–1,000 Nm$^3$, per Kl of heavy oil distillate; and LHSV used is 0.5–5 hr$^{-1}$, preferably 1–4 hr$^{-1}$.

The hydrocarbon-derived pour point depressant which is the component (III) according to this invention, is at least one compound selected from (1) a copolymer of ethylene and an α-olefin having the general formula $CH_2{=}CH{-}R$ wherein R is an alkyl group having at least one carbon atom, (2) poly-α-olefin (α-olefin polymer), (3) a hydrogenated, styrene-butadiene copolymer, (4) a condensed alkylnaphthalene and (5) an alkylated polystyrene.

The copolymers (1) of ethylene and α-olefin include ethylene-propylene copolymers, ethylene.butene-1 copolymers and ethylene.hexene-1 copolymers with ethylene-propylene copolymers being particularly preferred. The ethylene.α-olefin copolymers used herein are essentially amorphous oil-soluble ones having a number average molecular weight of usually 10,000–20,000, preferably 20,000–70,000, and an ethylene content of 30–90 mol%, preferably 40–80 mol%. The term "essentially amorphous" used herein means that the ethylene.α-olefin copolymers may have some degree of crystallization therein, the degree being usually 0–5%, preferably 0–2%. In addition, it is preferable that the copolymers have a relatively narrow distribution of molecular weight, the distribution being usually not higher than 8, particularly not higher than 4. The ethylene.α-olefin copolymers may be produced by known processes. The copolymerization may be effected by reacting ethylene with at least one α-olefin in an inert organic solvent containing an organic solvent containing an organic solvent-soluble specified homogeneous Ziegler type catalyst at atmospheric or somewhat superatmospheric pressure and at a temperature varying from a somewhat low temperature to a somewhat high temperature. The Ziegler type catalyst which may preferably be used is a coordination catalyst comprising a vanadium compound and organoaluminum compound such as $VOCl_3$—Al $(C_2H_5)_3$ system.

The poly-α-olefin or polymer of α-olefin (2) usable as the component (III) of this invention is a homopolymer or copolymer of α-olefin having the general formula $CH_2{=}CH{-}R$ wherein R is any one of alkyl groups which have 7–18, preferably 8–16, carbon atoms and are identical with, or different from, each other at the same time. The polymer of α-olefin (2) may also be a mixture of said homopolymer and copolymer. The polymer or copolymer contains $\{CH_2\}_n$ in which n is at least 6. These polymers of α-olefin may be produced in the presence of the same homogeneous Ziegler type catalyst as the aforesaid ethylene.α-olefin copolymer (1). The polymer of α-olefin has a number average molecular weight of usually 10,000–200,000, preferably 20,000–70,000 and is essentially amorphous; in addition, it should preferably have a relatively narrow molecular weight distribution.

The hydrogenated styrene-butadiene copolymer (3) usable as the component (III) according to this invention may be produced by a known process such as a process comprising copolymerizing styrene and butadiene in the presence of an alkyl-alkali metal compound, such as butyllithium, as a catalyst and hydrogenating the resulting styrene-butadiene copolymer using a known hydrogenating technique. It is desirable that at least 90%, preferably 100%, of the double bonds contained in the original styrene-butadiene copolymer be hydrogenated.

The hydrogenated styrene-butadiene copolymer (3) is preferably a random copolymer and has an average molecular weight of usually 10,000–200,000, preferably 20,000–70,000. The ratio of content between the styrene units and the butadiene units in the copolymer is 15–50:85–50, preferably 25–40:75–60.

The condensed alkylnaphthalene (4) usable as the component (III) is a condensate of dichloroparaffin and naphthalene and may be synthesized by a known process using a catalyst such as anhydrous $AlCl_3$. The dichloroparaffin usable herein is dichloride of a paraffin having about 15–60 carbon atoms. The condensed alkylnaphthalene usable herein has a molecular weight of several thousands to hundred thousands, usually about 2,000–70,000.

The alkylated polystyrene (5) usable as the component (III) according to this invention may be produced by a known process such as a process comprising subjecting styrene to radical polymerization in the presence of a peroxide, such as benzoyl peroxide, as an initiator. Starting polystyrene for the alkylated polystyrene (5) has a number average molecular weight of 10,000–150,000, preferably 20,000–70,000. The starting polystyrene is alkylated by contacting an alkyl halide therewith in the presence of a Friedel-Crafts type catalyst. The alkyl halide is represented by the general formula RX wherein R is an alkyl group having 6–20, preferably 8–18, carbon atoms and X is a halogen atom.

This invention is based on the finding or discovery that a mineral oil-derived electrical insulating oil (I) may remarkably be depressed in pour point without impairing the electrical properties thereof by adding thereto a specified oil (II) and a specified hydrocarbon-derived pour point depressant each in a specified proportion.

According to this invention, the blending ratio by weight of the mineral oil-derived electrical insulating oil (I) as the 1st component to the oil (II) as the 2nd component may be in the range of 50–95:5–50, preferably 60–90:40–10, and more preferably 70–85:30–15. The use of the oil (II) in a higher blending ratio than the oil (I) will not be effective in further improving the oil (I) in properties, particularly pour point, nor will it be economical. The use of the components (II) and (I) in a blending ratio of less than 5:95 will not be effective in remarkably depressing the pour point of the component (I) although such remarkable depression is characteristic of this invention. In addition, the hydrocarbon-derived pour point depressant (III) as the third component of the insulating oil composition of this invention may be used in amounts of 0.001–1.0%, preferably 0.05–0.2%, of the total weight of the components (I) and (II).

Furthermore, the electrical insulating oil composition of this invention may be incorporated with a known antioxidant such as DBPC (di-tert.-butyl-p-cresol), N-phenyl-α-naphthylamine, nicotinic acid or hydroquinoline.

This invention will be illustrated by the following non-limitative Examples wherein all percentages and parts are by weight unless otherwise specified.

EXAMPLE 1

There was obtained a distillate having a boiling range of 260°–380° C at atmospheric pressure and a sulfur content of 2.2 wt.% by distilling an Arabia crude oil at atmospheric pressure to obtain a bottom oil and distilling the thus-obtained bottom oil at a reduced pressure. The distillate so obtained was extracted with furfural in a solvent ratio (furfural/distillate) of 1.3 at an extracting temperature of 75°–90° C. to obtain a raffinate having a sulfur content of 0.8 wt.%. The thus-obtained raffinate was hydrofined at 310° C. under a hydrogen pressure of 40 kg/cm$^2$G in the presence of an alumina-carried NiO-$MoO_3$ catalyst (NiO:3.0 wt.%, $MoO_3$:14.0 wt.%) to obtain a hydrofined oil which was dewaxed with a benzene-toluene-methyl ethyl ketone mixed solvent in a solvent ratio (solvent/oil) of 1.6 at a cooling temperature of −30° C. and successively treated with clay at 70° C. for one hour thereby obtaining an electrical insulating oil (A).

Seventy-five (75) parts of the electrical insulating oil (A) were blended with 25 parts of polybutene (II-(2)) having an average molecular weight of about 280 to obtain a blended oil (B).

Furthermore, an essentially amorphous ethylene-propylene copolymer having an average molecular weight of 36,000 and a propylene content of 30 mol% was added to the blended oil (B) in the amount of 0.07% of the oil (B) thereby obtaining an electrical insulating oil (C) according to this invention. The properties of the electrical insulating oil (A), blended oil (B) and electrical insulating oil (C) are shown in Table 1.

For comparison, the said amorphous ethylene-propylene copolymer (III-(1)) was added to two equal portions of the electrical insulating oil (A) in the amounts of 0.07% and 0.1% of the portions of the oil (A) to obtain blended oils (D) and (E), respectively. The properties of these oils (D) and (E) are also indicated in Table 1.

For further comparison, the polybutene was incorporated with each of 0.05 wt.% and 0.2 wt.% of the amorphous ethylene-propylene copolymer to obtain blended oils (F) and (G). The pour points of the polybutene alone and the blended oils (F) and (G) are shown in Table 2.

For still further comparison, the blended oil (B) was incorporated with 0.1% of polymethacrylate which was a non-hydrocarbon derived pour point depressant, thereby to obtain a blended oil (H) the properties of which are also shown in Table 1.

As is apparent from Table 1 and Table 2, the addition of only the polybutene to the electrical insulating oil (A) was hardly effective in depressing the pour point of the oil (A), the addition of only the amorphous ethylene-propylene copolymer to the electrical insulating oil (A) was somewhat effective in depressing the pour point of the oil (A), while in the blended oils (F) and (G), the addition of the amorphous ethylene-propylene copolymer to the polybutene was ineffective in depressing the pour point of the polybutene.

The electrical insulating oil (C) obtained by the addition of both the polybutene and the amorphous ethylene-propylene copolymer to the insulating oil (A) exhibited a remarkably depressed pour point without imparing the other properties required in electrical insulating oils. Furthermore, an electrical insulating oil prepared by adding polymethacrylate to the blended oil (B) exhibited remarkably unsatisfactory electrical properties, steam emulsion number and like properties and was therefore unsatisfactory as such.

In Table 1, corrosion test and evaluation of corrosiveness were carried out in accordance with ASTM D-1275 and ASTM D-130, respectively.

Table 1

| | | Electrical insulating oil (A) | Blended oil (B) | Electrical insulating oil (C) | Blended oil (D) | Blended oil (E) | Blended oil (H) |
|---|---|---|---|---|---|---|---|
| Composition (weight) | Electrical insulating oil (A) | 100 | 75 | 75 | 100 | 100 | 75 |
| | Polybutene (II-(2)) | | 25 | 25 | | | 25 |
| | Ethylene-propylene copolymer (III-(1)) | | | 0.07 | 0.07 | 0.1 | |
| | Polymethacrylate | | | | | | 0.1 |
| Pour point °C. | | −25 | −27.5 | −45 | −32.5 | −35 | −40 |
| Volume resistivity 80° C., Ω · cm | | $3.7 \times 10^{15}$ | $3.8 \times 10^{15}$ | $4.1 \times 10^{15}$ | $2.7 \times 10^{15}$ | $2.5 \times 10^{15}$ | $0.86 \times 10^{15}$ |
| Dielectric loss tangent 80° C., % | | 0.005 | 0.004 | 0.003 | 0.007 | 0.006 | 0.018 |
| Steam emulsion number sec (JIS K-2517) | | 35 | 35 | 31 | 34 | 34 | 1200 or more |
| Corrosiveness (140° C. × 19 hr) | | 1 b | 1 b | 1 b | 1 b | 1 b | 2 a |
| Hydrogen gas absorbency mm Oil (Value for 150 min. − value for 50 min.) | | −24 | −47 | −46 | −45 | −44 | — |

Table 2

| | | Poly-butene | Blended oil (F) | Blended oil (G) |
|---|---|---|---|---|
| Composition (weight) | Polybutene (II-(2)) | 100 | 100 | 100 |
| | Ethylene-propylene copolymer (III-(1)) | | 0.05 | 0.2 |
| Pour point °C. | | −55 | −55 | −55 |

EXAMPLE 2

A distillate having a boiling range of about 280°–380° C. obtained by distilling a Duri crude oil at atmospheric pressure, was hydrofined at a reaction temperature of 330° C., a hydrogen pressure of 35 kg/cm$^2$G and a LHSV of 2.0 in the presence of the same alumina-carried NiO-$MoO_3$ catalyst as used in Example 1 thereby to obtain a hydrofined distillate which was treated with clay at 70° C. for one hour to yield an electrical insulating oil (I). Seventy (70) parts of the insulating oil (I) were blended with 30 parts of polybutene as used in Example 1 to obtain a blended oil (J) which was then incorporated with 0.01% of the ethylene-propylene copolymer as used in Example 1 thereby obtaining an electrical insulating oil (K) according to this invention. The properties of these oils are shown in Table 3. For comparison, the base oil (I) was incorporated with 0.01% of the ethylene-propylene copolymer to obtain a blended oil (L) having the properties shown in Table 3.

Table 3

| | | Electrical insulating oil (I) | Blended oil (J) | Electrical insulating oil (K) | Blended oil (L) |
|---|---|---|---|---|---|
| Composition (weight) | Electrical insulating oil (I) | 100 | 70 | 70 | 100 |
| | Polybutene (II-(2)) | | 30 | 30 | |
| | Ethylene-propylene copolymer (III-(1)) | | | 0.01 | 0.01 |
| Pour point °C. | | −25 | −27.5 | −42.5 | −30 |
| Volume resistivity 80° C., Ω · cm | | $1.8 \times 10^{15}$ | $2.4 \times 10^{15}$ | $2.5 \times 10^{15}$ | $2.1 \times 10^{15}$ |
| Dielectric loss tangent 80° C., % | | 0.009 | 0.008 | 0.009 | 0.007 |
| Steam emulsion number sec (JIS K-2517) | | 28 | 31 | 29 | 26 |

EXAMPLE 3

Seventy-five (75) parts of the electrical insulating oil (A) as obtained in Example 1 were blended with 25 parts of α-methylbenzylxylene (II-(1)) to obtain a blended oil (M). The blended oil (M) so obtained was incorporated with the amorphous ethylene-propylene copolymer as used in Example 1, in the amount of 0.05% of the oil (M) to obtain an electrical insulating oil (N). Separately, the blended oil (M) was incorporated with 0.1% of a styrene-butadiene copolymer having a number average molecular weight of about 40,000 and a styrene content of 32 mol%, in which copolymer 95% of the doubles bonds of the butadiene has been hydrogenated, thereby to obtain an electrical insulating oil (O). In addition, the electrical insulating oil (A) obtained in Example 1 was respectively incorporated with 0.05% of said amorphous ethylene-propylene copolymer and with 0.1% of said hydrogenated styrene-butadiene copolymer to obtain blended oils (P) and (Q).

The following Table 4 indicates the properties of these blended oils and electrical insulating oils.

For further comparison, α-methylbenzylxylene was incorporated with each of 0.05 wt.% of the amorphous ethylene-propylene copolymer and 0.05 wt.% of hydrogenated styrene-butadiene copolymer to obtain blended oils (R) and (S). Table 5 shows the pour points of α-methylbenzylxylene alone and the blended oils (R) and (S). As is apparent from Table 5, the addition of any one of said copolymers did not exhibit a pour point-depressing action in the blended oils (R) and (S).

Table 4

| | | Electrical insulating oil (A) | Blended oil (M) | Blended oil (P) | Electrical insulating oil (N) | Blended oil (Q) | Electrical insulating oil (O) |
|---|---|---|---|---|---|---|---|
| Composition (weight) | Electrical insulating oil (A) | 100 | 75 | 100 | 75 | 100 | 75 |
| | α-methylbenzylxylene (II-(1)) | | 25 | | 25 | | 25 |
| | Ethylene-propylene copolymer (III-(1)) | | | 0.05 | 0.05 | | |
| | Styrene-butadiene copolymer (III-(3)) | | | | | 0.1 | 0.1 |
| Pour point °C. | | −25 | −30 | −27.5 | −45 | −30 | −42.5 |
| Volume resistivity 80° C., Ω · cm | | $3.7 \times 10^{15}$ | $2.9 \times 10^{15}$ | $3.1 \times 10^{15}$ | $2.8 \times 10^{15}$ | $3.8 \times 10^{15}$ | $3.1 \times 10^{15}$ |
| Dielectric loss tangent 80° C., % | | 0.005 | 0.006 | 0.008 | 0.006 | 0.006 | 0.008 |
| Steam emulsion number sec (JIS K-2517) | | 35 | 30 | 36 | 38 | 36 | 30 |

Table 5

| | | α-methyl-benzyl-xylene | Blended oil (R) | Blended oil (S) |
|---|---|---|---|---|
| Composition (weight) | α-methylbenzyl-xylene (II-(1)) | 100 | 100 | 100 |
| | Ethylene-propylene copolymer (III-(1)) | | 0.05 | |
| | Styrene-butadiene copolymer (III-(3)) | | | 0.05 |
| Pour point °C. | | −50 | −50 | −50 |

EXAMPLE 4

A residual oil obtained by thermocracking naphtha at 830° C. and removing $C_{1-9}$ hydrocarbon fractions, was heat treated at 190° C. and atmospheric pressure for 15 hours and then distilled at reduced pressure thereby to recover a fraction boiling within the range of 270° to 380° C.

The fraction so recovered was hydrofined at 320° C. and a hydrogen pressure of 40 kg/cm$^2$G in the presence of a nickel (NiO 3.0 wt.%)-Mo ($MoO_3$ 14 wt.%) catalyst carried on alumina thereby obtaining a highly aromatic hydrocarbon oil (II-(3)) having a refractive index of ($n_d^{20}$) 1.59 and a $\%C_A$ of 60%.

Twenty (20) parts of the highly aromatic hydrocarbon oil (II-(3)) were blended with 80 parts of the electrical insulating oil (A) as obtained in Example 1 to obtain a blended oil (T).

The blended oil (T) was then incorporated with 0.1%, based on the weight thereof, of an alkylated polystyrene prepared by alkylating a polystyrene having an average molecular weight of 25,000 with dodecyl chloride in the presence of aluminum chloride as the catalyst, thereby to obtain an electrical insulating oil (V).

Separately, the blended oil (T) was incorporated with the styrene-butadiene copolymer as used in Example 3, in the amount of 0.1% of the oil (T) to obtain an electrical insulating oil (W). Table 6 indicates the properties of these blended oil and electrical insulating oils.

For further comparison, the high aromatic hydrocarbon oil (III-(3)) was incorporated with each of 0.1 wt.% of alkylated ($C_{10-12}$) polystyrene and 0.1 wt.% of styrene-butadiene copolymer to obtain blended oils which were then measured for pour point. The results are shown in Table 7, from which it is clear that the addition of any one of said polymers did not exhibit a pour point-depressing action.

Table 6

| | | Electrical insulating oil (A) | Blended oil (T) | Blended oil (U) | Electrical insulating oil (V) | Blended oil (Q) | Electrical insulating oil (W) |
|---|---|---|---|---|---|---|---|
| Composition (weight) | Electrical insulating oil (A) | 100 | 80 | 100 | 80 | 100 | 80 |
| | Highly aromatic oil (II-(3)) | | 20 | | 20 | | 20 |
| | Alkylated polystyrene (III-(5)) | | | 0.1 | 0.1 | | |
| | Styrene-butadiene copolymer (III-(3)) | | | | | 0.1 | 0.1 |
| Pour point °C. | | −25 | −32.5 | −32.5 | −45 | −30 | −42.5 |
| Volume resistivity 80° C., Ω · cm | | $3.7 \times 10^{15}$ | $1.5 \times 10^{15}$ | $2.8 \times 10^{15}$ | $2.1 \times 10^{15}$ | $3.8 \times 10^{15}$ | $2.3 \times 10^{15}$ |
| Dielectric loss tangent 80° C., % | | 0.005 | 0.009 | 0.006 | 0.008 | 0.006 | 0.008 |
| Steam emulsion number sec (JIS K-2517) | | 35 | 31 | 39 | 38 | 36 | 33 |

Table 7

| | | Highly aromatic oil | Blended oil | Blended oil |
|---|---|---|---|---|
| Composition (weight) | Highly aromatic oil (II-(3)) | 100 | 100 | 100 |
| | Alkylated poylstyrene (III-(5)) | | 0.1 | |
| | Styrene-butadiene copolymer (III-(3)) | | | 0.1 |

Table 7-continued

| | Highly aromatic oil | Blended oil | Blended oil |
|---|---|---|---|
| Pour point °C. | −57.5 | −57.5 | −57.5 |

EXAMPLE 5

A straight run naphtha was subjected to reforming at a reaction temperature of 480° to 520° C. and a reaction pressure of 20 kg/cm$^2$G in the presence of a platinum-rhenium-chlorine-alumina catalyst (Pt 0.3 wt.%, Re 0.3 wt.%, Cl 0.6 wt.%) to obtain a reaction product, from which the light fraction was removed to recover a fraction boiling at 270° to 380° C. The fraction so recovered was hydrofined at a reaction temperature of 330° C. and a hydrogen pressure of 40 kg/cm$^2$G in the presence of a nickel (NiO 3.0 wt.%)-molybdenum ($MoO_3$ 14 wt.%)-alumina catalyst and then treated with activated clay at a rate of 20 kg activated clay/kl oil at 60° C. for 30 minutes thereby to obtain a refined oil (II-(4)).

Twenty (20) parts of the refined oil (II-(4)) were incorporated with 80 parts of the electrical insulating oil (A) as obtained in Example 1 to obtain a blended oil (X).

The blended oil (X) was incorporated with 0.01%, based on the weight thereof, of the alkylated polystyrene as used in Example 4 to obtain an electrical insulating oil (Y).

Separately, the blended oil (X) was incorporated with 0.07%, based on the weight thereof, of the ethylene-propylene copolymer as used in Example 1 to obtain an electrical insulating oil (Z). The properties of these blended oil and electrical insulating oils are shown in Table 8.

For further comparison, 0.1 wt.% of alkylated ($C_{10-12}$) polystyrene and 0.07 wt.% of ethylene-propylene copolymer were each added to the hydrofined oil (II-(4)) to obtain blended oils which were measured for pour point with the results being shown in Table 9. From this Table, it is clear that the addition of any one of said polymers did not exhibit a pour point-depressing action.

Table 9-continued

| | Hydrofined oil | Blended oil | Blended oil |
|---|---|---|---|
| Alkylated polystyrene (III-(5)) | | | 0.1 |
| Pour point °C. | −55 | −55 | −55 |

What is claimed is:

1. An electrical insulating oil composition consisting essentially of (I) 50–95 parts by weight of a mineral oil-derived electrical insulating oil, the mineral oil being obtained from at least one member selected from the group consisting of naphthenic, mixed and paraffinic base crude oils, (II) 5–50 parts by weight of at least one oil selected from the group consisting of (1) diarylalkanes, (2) polybutene, (3) an oil having a refractive index of ($n_d^{20}$) 1.56–1.60 obtained by hydrofining a distillate contained in a fraction having a boiling range of about 250°–400° C. at atmospheric pressure obtained by the steam cracking or thermocracking of petroleum at about 600°–900° and (4) an oil obtained by hydrofining a distillate contained in a fraction having a boiling range of about 230°–450° C. at atmospheric pressure obtained as a by-product at the time of reforming a hydrocarbon oil in the presence of a noble metal catalyst, and (III) 0.001–1.0% by weight, based on the total weight of the oils (I) and (II), of a hydrocarbon-derived pour point depressant which is at least one member selected from the group consisting of (1) copolymers of ethylene and α-olefin having the general formula $CH_2{=}CH{-}R$ wherein R is an alkyl group having at least one carbon atom, (2) styrene-butadiene copolymers in hydrogenated form and (3) alkylated polystyrenes obtained by the reaction of a polystyrene having a number average molecular weight of 10,000–150,000 with an alkyl halide of the formula RX wherein R is an alkyl group having 6–20 carbon atoms and X is a halogen atom.

2. An electrical insulating oil composition according to claim 1 wherein in the oil (II), the diarylalkanes (1) are compounds represented by the general formula Table 8

| | | Electrical insulating oil (A) | Blended oil (X) | Blended oil (U) | Electrical insulating oil (Y) | Blended oil (D) | Electrical insulating oil (Z) |
|---|---|---|---|---|---|---|---|
| Composition (weight) | Electrical insulating oil (A) | 100 | 80 | 100 | 80 | 100 | 80 |
| | Hydrofined oil (II-(4)) | | 20 | | 20 | | 20 |
| | Alkylated polystyrene (III-(5)) | | | 0.1 | 0.1 | | |
| | Ethylene-propylene copolymer (III-(1)) | | | | | 0.07 | 0.07 |
| Pour point °C. | | −25 | −30 | −32.5 | −47.5 | −32.5 | −45 |
| Volume resistivity 80° C., Ω · cm | | $3.7 \times 10^{15}$ | $1.8 \times 10^{15}$ | $2.8 \times 10^{15}$ | $1.5 \times 10^{15}$ | $2.7 \times 10^{15}$ | $2.1 \times 10^{15}$ |
| Dielectric loss tangent 80° C., % | | 0.005 | 0.008 | 0.006 | 0.009 | 0.007 | 0.008 |
| Steam emulsion number sec (JIS K-2517) | | 35 | 32 | 39 | 38 | 34 | 30 |

Table 9

| | | Hydrofined oil | Blended oil | Blended oil |
|---|---|---|---|---|
| Composition (weight) | Hydrofined oil (II-(4)) | 100 | 100 | 100 |
| | Ethylene-propylene copolymer (III-(1)) | | 0.07 | |

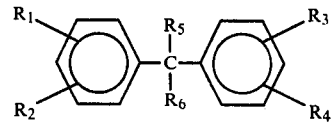

wherein $R_1$, $R_2$, $R_3$ and $R_4$ are each hydrogen or an alkyl group having 1–15 carbon atoms with the proviso that the total of carbon atoms of $R_1$–$R_4$ is at least 2, and $R_5$ and $R_6$ are each hydrogen or a methyl group.

3. An electrical insulating oil composition according to claim 1 wherein in the oil (II), the polybutene (2) is a liquid polymer mainly of isobutylene and has an average molecular weight of about 200–400.

4. An electrical insulating oil composition according to claim 1 wherein in the oil (II), the oil (3) has a refractive index of ($n_d^{20}$) 1.56–1.60 obtained by hydrofining a distillate contained in a fraction having a boiling range of about 250°–400° C. at atmospheric pressure obtained by the cracking of petroleum at about 600°–900° C.

5. An electrical insulating oil composition according to claim 1 wherein in the oil (II), the oil (4) is obtained by hydrofining a distillate contained in a fraction having a boiling range of about 230°–450° C. at atmospheric pressure obtained as a by-product at the time of reforming a hydrocarbon oil in the presence of a noble metal catalyst.

6. An electrical insulating oil composition according to claim 1 wherein the hydrocarbon-derived pour point depressant (III) is an essentially amorphous ethylene-propylene copolymer having an average molecular weight of 10,000–200,000 and an ethylene content of 30–90 mol%.

7. An electrical insulating oil composition according to claim 1 wherein the hydrocarbon-derived pour point depressant (III) is a hydrogenated styrene-butadiene copolymer having an average molecular weight of 10,000–200,000 with a ratio of content between the styrene units and butadiene units in the copolymer being 15–50:85–50.

8. An electrical insulating oil composition according to claim 1 wherein the hydrocarbon-derived pour point depressant (III) is an alkylated polystyrene having an average molecular weight of 20,000–70,000.

9. An electrical insulating oil composition consisting essentially of (I) 50–95 parts by weight of a mineral oil-derived electrical insulating oil, (II) 5–50 parts by weight of diarylalkanes represented by the general formula

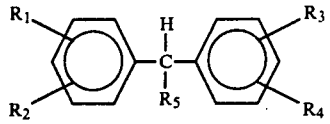

wherein $R_1$, $R_2$, $R_3$ and $R_4$ are each hydrogen or an alkyl group having 1–15 carbon atoms with the proviso that the total of carbon atoms of $R_1$–$R_4$ is at least 2, and $R_5$ is hydrogen or a methyl group, and (III) 0.001–1.0% by weight of a hydrocarbon-derived pour point depressant, based on the total weight of the oils (I) and (II).

10. An electrical insulating oil composition consisting essentially of (I) 50–95 parts by weight of a mineral oil-derived electrical insulating oil, the mineral oil being obtained from at least one member selected from the group consisting of naphthenic, mixed and paraffinic base crude oils, (II) 5–50 parts by weight of diarylalkanes represented by the general formula

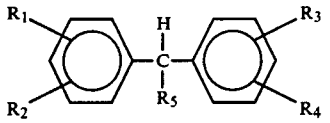

wherein $R_1$, $R_2$, $R_3$ and $R_4$ are each hydrogen or an alkyl group having 1–15 carbon atoms with the proviso that the total of carbon atoms of $R_1$–$R_4$ is at least 2, and $R_5$ is hydrogen or a methyl group, and (III) 0.001–1.0% by weight based on the total weight of the oils (I) and (II), of a hydrocarbon-derived pour point depressant which is at least one member selected from the group consisting of (1) copolymers of ethylene and α-olefin having the general formula $CH_2{=}CH{-}R$ wherein R is an alkyl group having at least one carbon atom, (2) styrene-butadiene copolymers in hydrogenated form and (3) alkylated polystyrenes obtained by the reaction of a polystyrene having a number average molecular weight of 10,000–150,000 with an alkyl halide of the formula RX wherein R is an alkyl group having 6–20 carbon atoms and X is a halogen atom.

* * * * *